US010941013B2

(12) United States Patent
Egawa

(10) Patent No.: US 10,941,013 B2
(45) Date of Patent: Mar. 9, 2021

(54) SHEET POST-PROCESSING DEVICE AND IMAGE FORMING SYSTEM INCLUDING SAME

(71) Applicant: KYOCERA Document Solutions Inc., Osaka (JP)

(72) Inventor: Keisuke Egawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 42 days.

(21) Appl. No.: 16/549,805

(22) Filed: Aug. 23, 2019

(65) Prior Publication Data

US 2020/0071116 A1 Mar. 5, 2020

(30) Foreign Application Priority Data

Aug. 30, 2018 (JP) ..... JP2018-161569

(51) Int. Cl.
*B65H 37/04* (2006.01)
*B65H 29/12* (2006.01)
*B65H 31/02* (2006.01)

(52) U.S. Cl.
CPC ..... *B65H 37/04* (2013.01); *B65H 29/125* (2013.01); *B65H 31/02* (2013.01)

(58) Field of Classification Search
CPC ..... B65H 37/04; B65H 29/125; B65H 31/02; B65H 43/08; B65H 2404/1521; B65H 31/36; B65H 29/22; B65H 31/34; G03G 15/6541
See application file for complete search history.

(56) References Cited

U.S. PATENT DOCUMENTS 5,288,062 A * 2/1994 Rizzolo ..... B65H 31/3027 270/58.12
9,409,735 B2 * 8/2016 Abe ..... B65H 31/36
2006/0017210 A1 * 1/2006 Sato ..... B27F 7/006 270/58.08
2006/0097445 A1 * 5/2006 Fukatsu ..... B65H 31/34 271/220
2008/0054552 A1 * 3/2008 Saito ..... B65H 31/26 271/221
2008/0075510 A1 * 3/2008 Kubo ..... B65H 9/101 399/407
2013/0049279 A1 2/2013 Nagata ..... 270/58.07

FOREIGN PATENT DOCUMENTS

JP 2013-47125 A 3/2013

* cited by examiner

*Primary Examiner* — Patrick H Mackey
(74) *Attorney, Agent, or Firm* — Stein IP, LLC

(57) ABSTRACT

A paper sheet post-processing device includes a processing tray, an aligning member that aligns paper sheets on the processing tray, a swingable holder that supports the aligning member, a swinging mechanism that causes the holder to swing, and a control unit that controls the swinging mechanism. The swinging mechanism includes a rotation shaft inserted into a shaft insertion portion of the holder with play in a rotation direction. The control unit controls the rotation shaft to rotate and stop at a predetermined rotation angle position corresponding to a stack height of the sheets stacked on the processing tray, so that the holder is disposed at a contact position. At the contact position, the holder is allowed to swing in a retracting direction with respect to the rotation shaft within a predetermined play range. The play range is set to be larger in proportion to the stack height of the sheets.

9 Claims, 9 Drawing Sheets

SHEET POST-PROCESSING DEVICE AND IMAGE FORMING SYSTEM INCLUDING SAME

INCORPORATION BY REFERENCE

This application is based upon and claims the benefit of priority from the corresponding Japanese Patent Application No. 2018-161569 filed Aug. 30, 2018, the entire contents of which are hereby incorporated by reference.

BACKGROUND

The present disclosure relates to a sheet post-processing device, which performs a post-processing on sheets such as paper sheets on which images are formed by an image forming apparatus such as a copier, a facsimile machine, or a printer, and relates to the image forming system including the sheet post-processing device.

There is conventionally used a paper sheet post-processing device that is capable of performing a post-processing such as a stapling process, in which a plurality of paper sheets (sheets) with images formed by an image forming apparatus such as a copier or a printer are stacked so that a bundle of the stacked paper sheets is stapled with staples, and a punching process for forming punch holes (punching) with a punching device.

Such a paper sheet post-processing device includes a processing tray on which a predetermined number of paper sheets with images formed thereon are stacked, an aligning member that contacts with an upper surface of the topmost paper sheet on the processing tray and rotates to align the paper sheets in a conveying direction, a holder that supports the aligning member in a rotatable manner and is swingable, and a swinging mechanism that causes the holder to swing. Further, the stapling process, a shift discharge process, and the like are performed on the paper sheet stack on the processing tray.

The holder is configured to be swingable between a contact position at which the aligning member contacts with the upper surface of the topmost paper sheet on the processing tray and a retract position at which the aligning member retracts from the processing tray. In order to avoid excessive pressing of the aligning member toward the paper sheet, the holder is configured to be swingable (i.e. to have a play) by a predetermined angle in a retracting direction when it is disposed the contact position.

SUMMARY

A sheet post-processing device according to a first aspect of the present disclosure includes a conveying member, a processing tray, a discharge tray, a processing unit, an aligning member, a holder, a swinging mechanism, and a control unit. The conveying member conveys sheets. The processing tray is disposed on a downstream side of the conveying member in a sheet conveying direction, and has a sheet stacking surface for receiving and stacking the sheets. The discharge tray is disposed on a downstream side of the processing tray in a sheet discharge direction. The processing unit performs a post-processing on the sheets on the processing tray. The aligning member contacts with an upper surface of a topmost sheet of the sheets on the processing tray and aligns the sheets on the processing tray in the sheet discharge direction. The holder supports the aligning member and is swingable. The swinging mechanism causes the holder to swing. The control unit controls the swinging mechanism. The holder is swingable between a contact position at which the aligning member contacts with the upper surface of the topmost sheet of the sheets and a retract position at which the aligning member retracts from the upper surface of the topmost sheet the sheets. The swinging mechanism includes a rotation shaft inserted into a shaft insertion portion of the holder with play in a rotation direction so as to be a swinging center of the holder, and a drive part for driving the rotation shaft to rotate. The control unit controls the rotation shaft to rotate and stop at a predetermined rotation angle position corresponding to a stack height of the sheets stacked on the processing tray, so that the holder is disposed at the contact position. At the contact position, the holder is allowed to swing in a retracting direction with respect to the rotation shaft within a predetermined play range. The play range is set to be larger in proportion to the stack height of the sheet.

A sheet post-processing device according to a second aspect of the present disclosure includes a conveying member, a processing tray, a processing unit, an aligning member, a holder, a swinging mechanism, and a control unit. The conveying member conveys sheets. The processing tray is disposed on a downstream side of the conveying member in a sheet conveying direction, and has a sheet stacking surface for receiving and stacking the sheets. The processing unit performs a post-processing on the sheets on the processing tray. The aligning member contacts with an upper surface of a topmost sheet of the sheets stacked on the processing tray and aligns the sheets on the processing tray in the sheet discharge direction. The holder supports the aligning member. The swinging mechanism causes the holder to swing. The control unit controls the swinging mechanism. The holder is swingable between a contact position at which the aligning member contacts with the upper surface of the topmost sheet of the sheets and a retract position at which the aligning member retracts from the upper surface of the topmost sheet of the sheets. The swinging mechanism includes a rotation shaft inserted into a shaft insertion portion of the holder with play in a rotation direction so as to be a swinging center of the holder, and a drive part for driving the rotation shaft to rotate. The control unit controls the rotation shaft to rotate and stop at a predetermined rotation angle position corresponding to stack height of the sheets stacked on the processing tray, so that the holder is disposed at the contact position. At the contact position, the holder is allowed to swing in the retracting direction with respect to the rotation shaft within a predetermined play range.

Other objects of the present disclosure and specific advantages obtained by the present disclosure will become more apparent from the description of the embodiment given below.

DETAILED DESCRIPTION

Hereinafter, an embodiment of the present disclosure is described with reference to the drawings.

Figure 1:
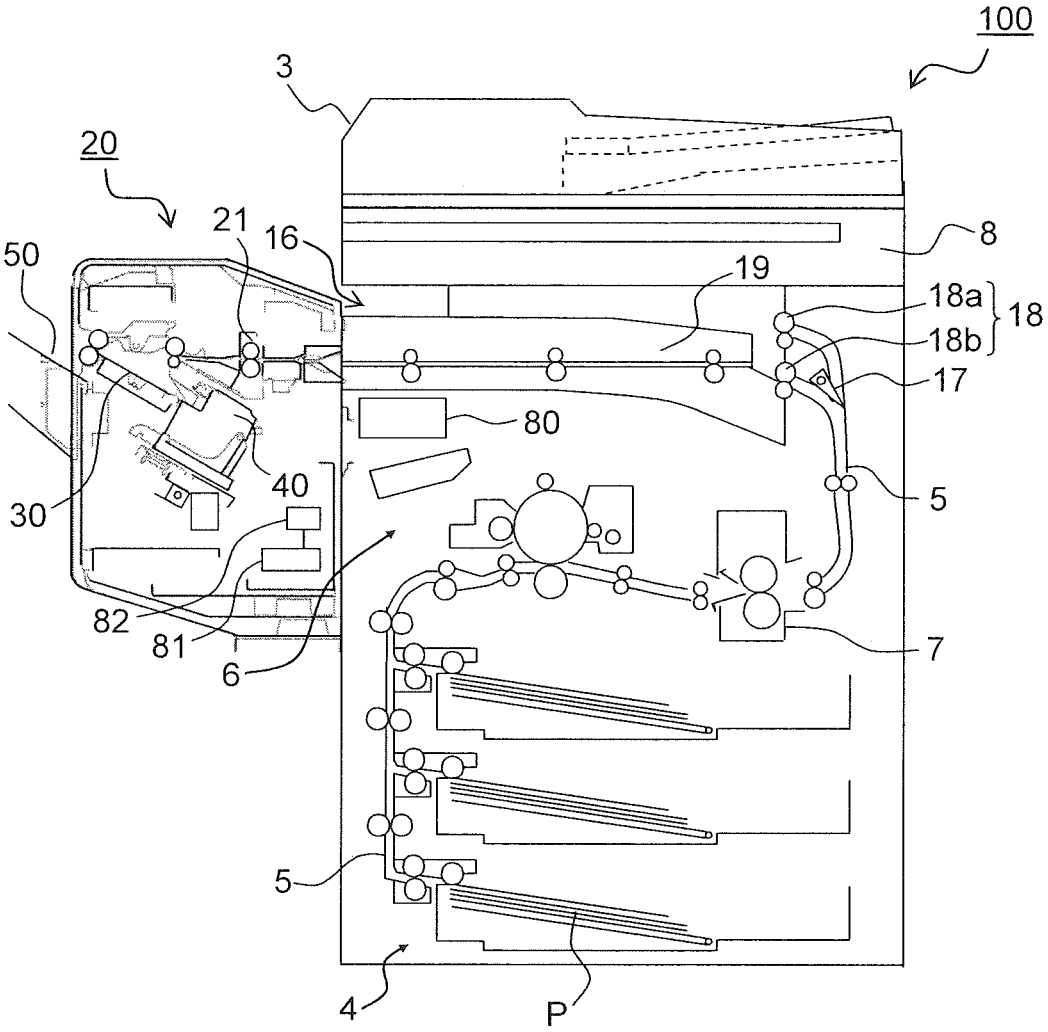
FIG. 1 is a schematic diagram illustrating an internal structure of an image forming apparatus and a paper sheet post-processing device of one embodiment of the present disclosure.

First, with reference to FIG. 1, an image forming system is described, which includes an image forming apparatus 100 and a paper sheet post-processing device 20 of one embodiment of the present disclosure. Note that, in this embodiment, a multifunction peripheral is shown as an example of the image forming apparatus 100, but the paper sheet post-processing device 20 of the present disclosure can be similarly connected to an apparatus other than a digital multifunction peripheral, such as a laser printer, an ink-jet printer, or a facsimile machine.

As illustrated in FIG. 1, the image forming apparatus 100 is a so-called in-body discharge type digital multifunction peripheral. An upper part of a main body of the image forming apparatus 100 is provided with an image reader unit 8 that reads an image of a document as an electric signal, and a document feeder device 3 is attached to an upper side thereof. A left side part of the main body of the image forming apparatus 100 is provided with the paper sheet post-processing device (sheet post-processing device) 20.

The main body of the image forming apparatus 100 is provided with a sheet feed unit 4 for feeding paper sheets (sheets) P, a sheet conveying path 5, an image forming unit 6 that forms a toner image on the paper sheet P, a fixing device 7 for fixing the toner image on the paper sheet P, and a sheet discharge unit 18 for conveying the paper sheet P after the fixing so as to discharge the same from the main body of the image forming apparatus 100.

In addition, the main body of the image forming apparatus 100 is provided with an in-body discharge space 16, which is formed to open largely to the left and front sides. This in-body discharge space 16 is provided with a relay unit 19, which receives and places the paper sheets P discharged by the sheet discharge unit 18, and enables to convey the paper sheet P to the paper sheet post-processing device 20 when a predetermined post-processing is performed on the paper sheets P.

The sheet discharge unit 18 includes an upper discharge roller pair 18*a* and a lower discharge roller pair 18*b* disposed just below the upper discharge roller pair 18*a*, so that the paper sheet P after being conveyed along the sheet conveying path 5 is guided by a switching claw 17 to an upper conveying path or a lower conveying path.

The paper sheet P guided by the switching claw 17 to the upper conveying path is discharged from the upper discharge roller pair 18*a* to the left, while the paper sheet P guided by the switching claw 17 to the lower conveying path is discharged by the lower discharge roller pair 18*b* to the left. Then, the paper sheet P discharged from the lower discharge roller pair 18*b* is carried into the relay unit 19. The paper sheet P carried into the relay unit 19 passes through inside of the relay unit 19 and is carried into the paper sheet post-processing device 20. The switching claw 17 is configured to switch its guide direction according to a main body control unit 80. Note that the main body control unit 80 is configured to control operation of the image forming apparatus 100 and to be capable of communicating with a post-processing control unit 81 of the paper sheet post-processing device 20, so as to control the post-processing control unit 81. The post-processing control unit 81 is one example of the "control unit" in the present disclosure.

Inside of the paper sheet post-processing device 20, there are disposed a punching device 21 that forms punch holes in the carried-in paper sheets P, a processing tray 30 that places (stacks) a plurality of the carried-in paper sheets P, and a stapler (processing unit) 40 that staples the paper sheets stacked on the processing tray 30 with staples. A side surface of the paper sheet post-processing device 20 is provided with a discharge tray 50 that can move up and down to a position suitable for discharging the paper sheets P. The discharge tray 50 is provided with a pair of align cursors 55 (see FIG. 2) that contact side edges in a width direction of the paper sheets P stacked on the discharge tray 50 so that the paper sheets P are aligned in the width direction.

The punching device 21 is disposed in an upper part of the paper sheet post-processing device 20, and forms a plurality of punch holes along one side edge of the paper sheet P parallel to the conveying direction (on the front or back side of the apparatus). A carry-in detection sensor (not shown), which detects a front end of the paper sheet P carried into the paper sheet post-processing device 20 by the sheet carry-in roller pair in the relay unit 19, is disposed on an upstream side of the punching device 21 and at substantially the center part of the same in a direction perpendicular to the sheet conveying direction (in a direction perpendicular to the paper plane of FIG. 1).

Figure 2:
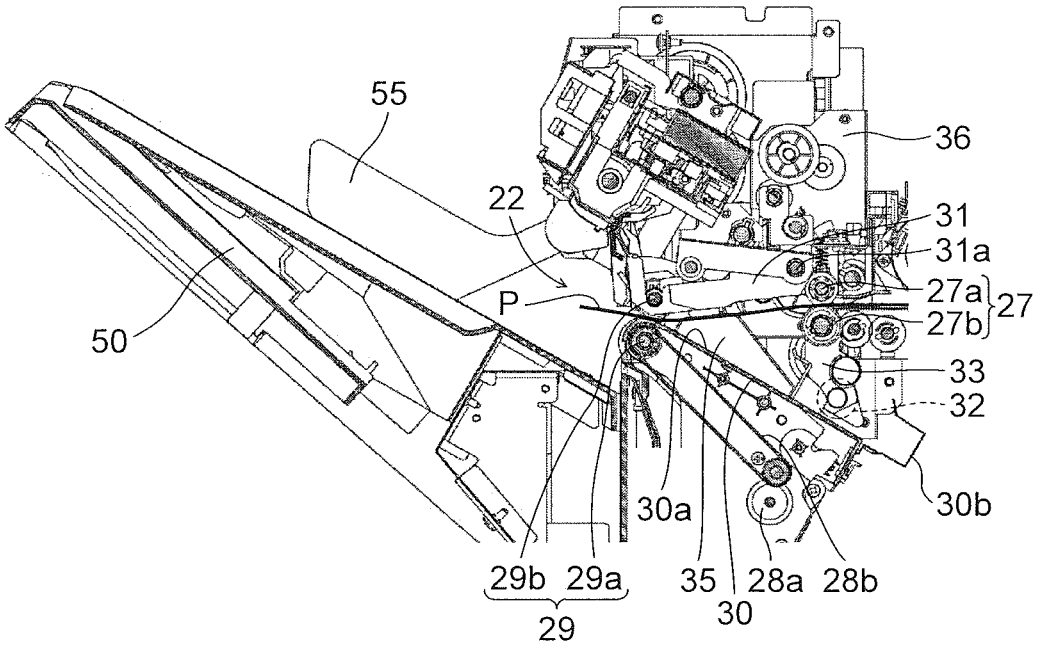
FIG. 2 is a cross-sectional view illustrating a structure of a processing tray and its vicinity of the paper sheet post-processing device of one embodiment of the present disclosure.

FIG. 2 is a cross-sectional view illustrating a structure of the processing tray 30 and its vicinity of the paper sheet post-processing device 20 of one embodiment of the present disclosure. An intermediate roller pair (conveying member) 27 is disposed on the downstream side of the punching device 21 (see FIG. 1) in the sheet conveying direction. An actuator type sheet detection sensor (not shown), which detects passing of the paper sheet P, is disposed on the upstream side of the intermediate roller pair 27.

Further, below the intermediate roller pair 27, there are disposed the processing tray 30 that aligns and places a predetermined number of the paper sheets P conveyed by the intermediate roller pair 27, and the stapler 40 (see FIG. 1) that performs a stapling process on a bundle of the paper sheets P (paper sheet stack) stacked on the processing tray 30.

A paper sheet discharge port (sheet discharge port) 22 is disposed on the downstream side (the left side in FIG. 2) of the processing tray 30 in the sheet discharge direction, and the paper sheet discharge port 22 is provided with a discharge roller pair 29 that discharges the paper sheets P onto the discharge tray 50. A plurality of (two in this example) discharge roller pairs 29 are disposed along the sheet width direction (the direction perpendicular to the paper plane of FIG. 2, or the direction perpendicular to the sheet conveying direction). In addition, the discharge roller pair 29 is constituted of a rubber lower discharge roller 29*a* that can rotate forward and reverse, to which a rotation drive force is transmitted from a drive motor (not shown) via a discharge gear 28*a*, a transmission belt 28*b*, and the like, and a resin upper discharge roller 29*b* that rotates following the lower discharge roller 29*a*.

The upper discharge roller 29*b* is supported by a discharge roller holder 31 that is swingable up and down about a rotation shaft 31*a*, and the lower discharge roller 29*a* and the upper discharge roller 29*b* can contact and separate from each other. The discharge roller holder 31 is driven to swing by a holder drive mechanism 36 constituted of a stepping motor and gears, or a motor, gears, a cam, and the like, for example. The holder drive mechanism 36 is controlled by the post-processing control unit 81 (see FIG. 1).

The upper discharge roller 29*b* is disposed by the holder drive mechanism 36 selectively at one of a nip-forming position (the position of FIG. 2) contacting with the lower discharge roller 29*a* to form a nip, and a separate position (not shown) separated upward from the upper discharge roller 29*b*.

Above the processing tray 30 on the downstream side (the left side of FIG. 2) of the intermediate roller pair 27, there is disposed a knock member (not shown) that knocks downward the paper sheet P carried in by the intermediate roller pair 27, so that the paper sheet P is laid along a paper sheet stacking surface (sheet stacking surface) 30*a* of the processing tray 30. The intermediate roller pair 27 is constituted of an upper roller 27*a* that can be driven to rotate by a drive motor (not shown) and a lower roller 27*b* that rotates following the upper roller 27*a*. Below the lower roller 27*b*, there are disposed an aligning roller holder 33 that is swingable about a rotation shaft of the lower roller 27*b* (a rotation shaft 130 described later), and an aligning roller (aligning member) 32 that is supported by the aligning roller holder 33 in a rotatable manner and can be rotated by a rotation drive force from a drive motor (not shown). A pair of the aligning rollers 32 is disposed along the sheet width direction. Note that the aligning roller holder 33 is one example of the "holder" in the present disclosure.

The processing tray 30 is disposed to be inclined downward toward the rear end of the paper sheet P (an upstream end in the sheet discharge direction) (the right side of FIG. 2). When the aligning roller 32 rotates in a counterclockwise direction in FIG. 2 in a state swung downward about the rotation shaft of the lower roller 27*b*, the paper sheet P is drawn in from the upstream end (rear end) side onto the processing tray 30, and the upstream end of the paper sheet P comes into contact with a stop part 30*b*. In this way, the paper sheets P are stacked on the processing tray 30 with upstream ends aligned. In addition, the processing tray 30 is provided with a pair of side end align cursors (processing unit) 35 that aligns the stack of the predetermined number of paper sheets stacked on the processing tray 30 in the sheet width direction perpendicular to the sheet conveying direction.

Note that the aligning roller 32 is made of a material such as resin having a relatively small coefficient of friction against the paper sheet P, so as to rotate freely on the paper sheet P after the rear end of the paper sheet P comes into contact with the stop part 30*b* of the processing tray 30. Detailed structure of the aligning roller 32, the aligning roller holder 33, and their vicinity will be described later.

The stapler 40 (see FIG. 1) can be moved by a moving mechanism (not shown) in the sheet width direction, and it moves to a predetermined position along a lower end part of the processing tray 30 in accordance with content of the stapling process.

Next, with reference to FIG. 1, an operation of the paper sheet post-processing device 20 is described. When the paper sheet P after the image forming apparatus 100 has formed an image thereon is carried in, if punch hole formation is instructed, punch holes are formed at predetermined positions (e.g. two positions along the side edge on the front side of the apparatus) of the paper sheet P conveyed by the punching device 21. If the punch hole formation is not instructed, the paper sheet P passes through the punching device 21 without punching.

Then, the paper sheet P is further conveyed to the downstream side by the intermediate roller pair 27 (see FIG. 2).

If a post-processing on the processing tray 30 (a staple process (stapling process) by the stapler 40 and a shift discharge process) is not instructed, the paper sheet P after passing through the punching device 21 is discharged onto the discharge tray 50 as it is by the intermediate roller pair 27 and the discharge roller pair 29, as illustrated in FIG. 2. In this case, the discharge roller holder 31 is swung downward, and the upper discharge roller 29*b* is disposed at the nip-forming position contacting with the lower discharge roller 29*a*.

On the other hand, if the post-processing on the processing tray 30 is instructed, the knock member (not shown) is driven so that the paper sheet P is laid along the processing tray 30 at timing when the rear end of the paper sheet P passes the intermediate roller pair 27. In this case, the discharge roller holder 31 is swung upward, and the upper discharge roller 29*b* is disposed at a position separated from the lower discharge roller 29*a* (at the separate position). In this state, the aligning roller 32 is rotated forward (in the counterclockwise direction in FIG. 2), so that the paper sheet P is drawn in along the processing tray 30, and the rear end is aligned at the stop part 30*b*. The stop part 30*b* is not continuously formed over the entire region in the sheet width direction but is cut out partially. In this case, the front end of the paper sheet P protrudes from the discharge roller pair 29 to the downstream side.

Further, if the stapling process is instructed, when reception of one bundle of (a predetermined number of) paper sheets P is finished, the stapler 40 is moved to a cut-out position of the stop part 30*b* so that the stapling process is performed on the rear end of the paper sheet stack. After the stapling process, the aligning roller 32 is disposed at a retract position retracted upward as described later.

In addition, if the shift discharge process is instructed, when reception of one bundle of (a predetermined number of) paper sheets P is finished, the side end align cursor 35 is disposed at an align position (a reference position) at which the paper sheets P are aligned, or a position (a shift position) shifted from the align position by a predetermined amount in a direction perpendicular to the discharge direction (in the sheet width direction). Then, the discharge roller holder 31 is swung downward and moved to a position (an abutting position) at which the upper discharge roller 29*b* abuts the lower discharge roller 29*a*. After that, the lower discharge roller 29*a* is rotated forward (in the counterclockwise direction in FIG. 2), so that the paper sheet stack is conveyed along the processing tray 30 to the downstream side in the sheet discharge direction and is discharged onto the discharge tray 50. In this way, the paper sheet stacks are discharged alternately to a reference discharge position on the discharge tray 50 and a shift discharge position shifted from the reference discharge position by a predetermined amount in the direction perpendicular to the discharge direction (in the sheet width direction). Thus, when the paper sheet stacks are discharged onto the discharge tray 50, they are sorted and stacked alternately in the sheet width direction. Note that when the paper sheet stack on the processing tray 30 is discharged, it is possible to use a bundle discharge member (not shown) to discharge the paper sheet stack, which supports the upstream end (rear end) of the paper sheet stack and moves in the discharge direction on the paper sheet stacking surface 30*a* of the processing tray 30.

Next, a structure of the aligning roller 32, the aligning roller holder 33, and their vicinity is described in detail.

Figure 3:
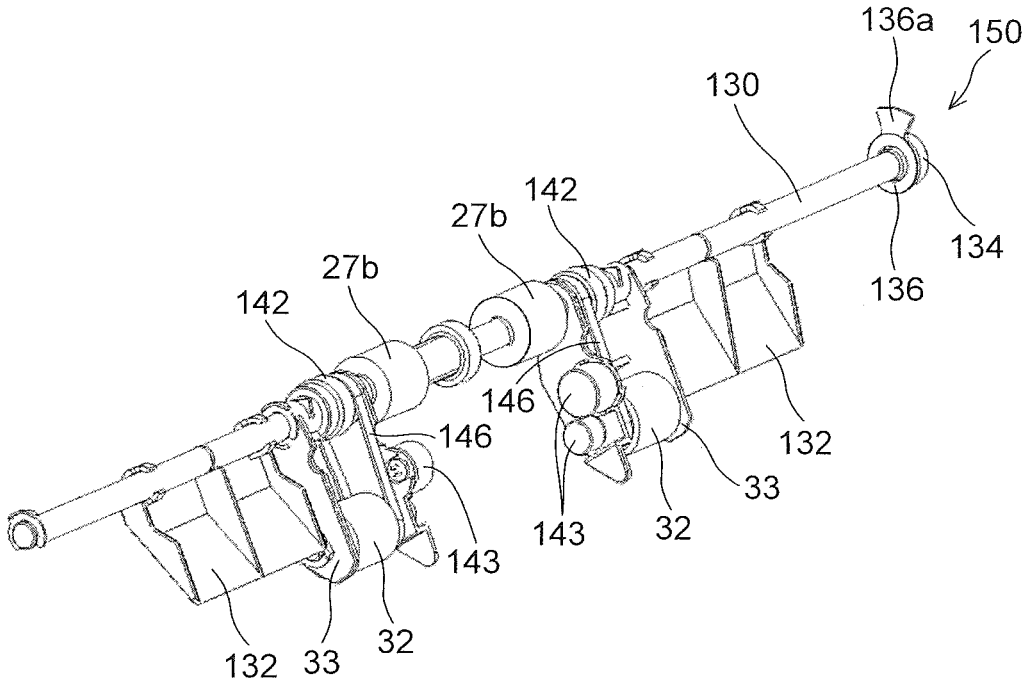
FIG. 3 is a perspective view illustrating a structure of an aligning roller, a rotation shaft, and their vicinity of the paper sheet post-processing device of one embodiment of the present disclosure.
Figure 4:
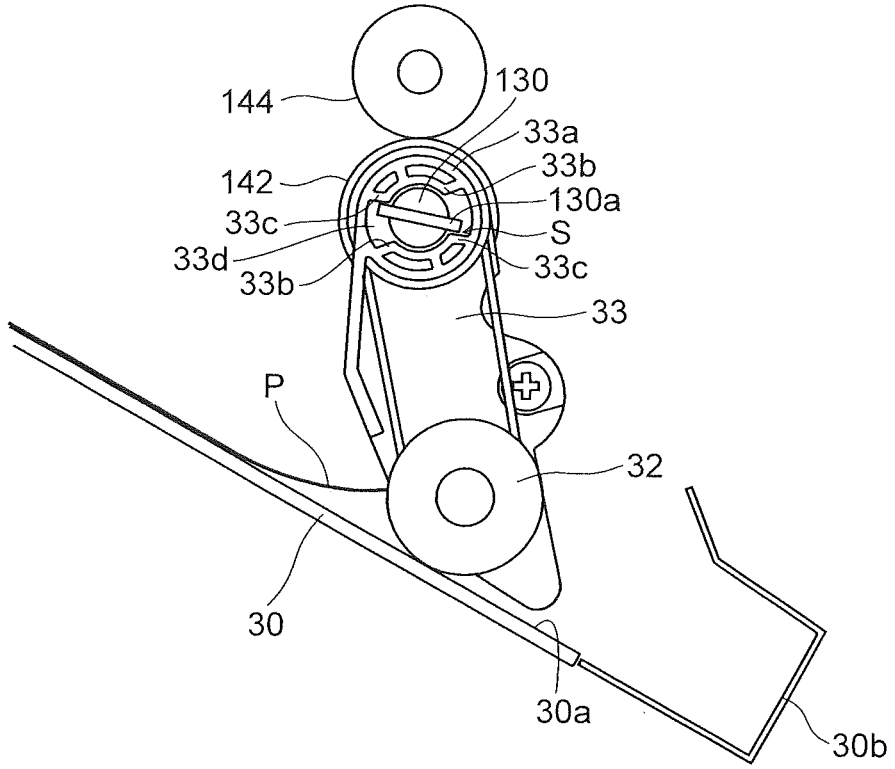
FIG. 4 is a cross-sectional view illustrating a structure of the aligning roller and its vicinity of the paper sheet post-processing device of one embodiment of the present disclosure, in a state where a roller holder is disposed at a contact position.

As illustrated in FIGS. 3 and 4, the aligning roller 32 is attached to the lower end part of the aligning roller holder 33 in a rotatable manner. The aligning roller holder 33 is disposed to swing in conjunction with rotation of the rotation shaft 130 (the rotation shaft of the lower roller 27*b* (see FIG. 2)). The lower roller 27*b* is attached in a rotatable manner with respect to the rotation shaft 130.

As illustrated in FIG. 3, the rotation shaft 130 is provided with guide members 132 attached in a rotatable manner, which guide the rear end of the paper sheet P to the stop part 30*b* of the processing tray 30, on the outsides of the pair of aligning roller holders 33. In addition, an input gear 134 and a light shielding member 136, which rotate as a unit with the rotation shaft 130, are fixed to one end part (the right end part in FIG. 3) of the rotation shaft 130. The input gear 134 is connected to the stepping motor (not shown) via a connection gear 138 (see FIG. 5). The light shielding member 136 is provided with a fan-shaped light shielding piece 136*a* in an integral manner, which protrudes outward in a radial direction. Note that the input gear 134, the connection gear 138, and the stepping motor are one example of the "drive part" in the present disclosure.

Figure 5:
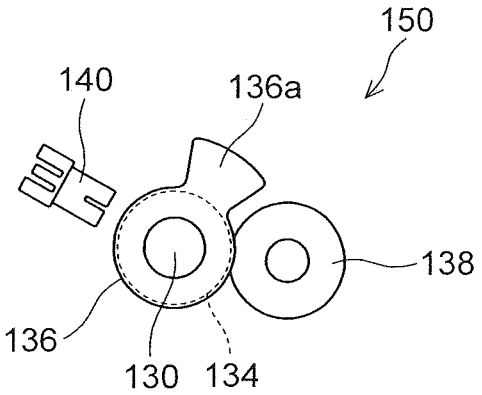
FIG. 5 is a diagram illustrating a structure of a light shielding member and its vicinity of the paper sheet post-processing device of one embodiment of the present disclosure, and shows a rotation angle position of the light shielding member in the state of FIG. 4.

In addition, as illustrated in FIG. 5, an angle detection sensor (detection unit) 140 constituted of a PI sensor including a light emitting portion and a light receiving portion is disposed near one end part of the rotation shaft 130. The angle detection sensor 140 detects whether an optical path is open or blocked by the light shielding piece 136*a* of the light shielding member 136, and transmits the detection result to the post-processing control unit 81. Note that the rotation shaft 130, the angle detection sensor 140, the light shielding member 136, the input gear 134, the connection gear 138, the stepping motor (not shown), an engaging pin 130*a* described later, and the like constitute a swinging mechanism 150 that causes the aligning roller holder 33 to swing.

Figure 6:
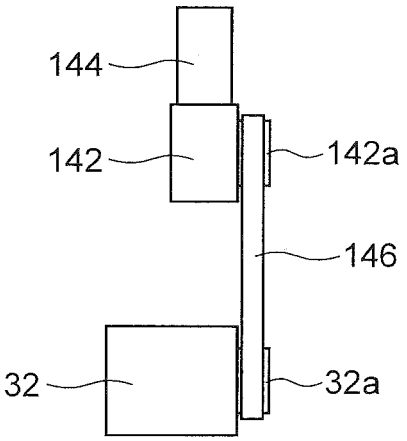
FIG. 6 is a diagram illustrating a structure of the aligning roller, a transmission gear, and their vicinity of the paper sheet post-processing device of one embodiment of the present disclosure.

In addition, as illustrated in FIG. 3, a transmission gear 142 for transmitting a rotation drive force to the aligning roller 32 is attached at a predetermined position of the rotation shaft 130 in a rotatable manner with respect to the rotation shaft 130. As illustrated in FIG. 6, the transmission gear 142 is connected to a drive motor (not shown) via an intermediate gear 144 (see FIG. 6). The transmission gear 142 is integrally provided with a pulley 142*a*, and the aligning roller 32 is integrally provided with a pulley 32*a*. A transmission belt 146 is wound around the pulley 142*a* and the pulley 32*a*, and the aligning roller 32 rotates when the transmission gear 142 rotates. Note that the aligning roller 32 rotates in the counterclockwise direction in FIG. 4 at least when the aligning roller holder 33 is disposed at a position other than the retract position, and it always rotates in this embodiment.

The aligning roller holder 33 is disposed so as to be inclined to the upstream side in the sheet discharge direction from a shaft insertion portion 33*a* described later toward its distal end, and it is swingable between a contact position (the position of FIG. 4 or 9) at which the aligning roller 32 contacts with the paper sheet stacking surface 30*a* or the upper surface of the paper sheet P, and a retract position (the position of FIG. 7) at which the aligning roller 32 retracts upward from the paper sheet stacking surface 30*a*. In addition, the aligning roller holder 33 is configured to be swingable about a downstream side end part in the sheet discharge direction (about the shaft insertion portion 33*a* described later), and is configured to swing (bound) a little in a retracting direction when it contacts with the rear end of the paper sheet P.

In addition, the aligning roller holder 33 is swung in the retracting direction (the counterclockwise direction in FIG. 4) from the contact position (the position of the FIG. 4) to the retract position (the position of the FIG. 7) by the swinging mechanism 150, while it is swung in the contacting direction (the clockwise direction in FIG. 4) from the retract position to the contact position by gravity action.

Specifically, the aligning roller holder 33 has the shaft insertion portion 33*a* into which the rotation shaft 130 is inserted. The rotation shaft 130 is provided with the engaging pin 130*a* protruding in the radial direction. The engaging pin 130*a* penetrates the rotation shaft 130 in the radial direction. The shaft insertion portion 33*a* is provided with engaging grooves 33*d* that engage with the engaging pin 130*a*, and the engaging groove 33*d* has abutting walls 33*b* and 33*c* that face each other with a predetermined spacing in the rotation direction, sandwiching the engaging pin 130*a*. In other words, the aligning roller holder 33 is supported by the rotation shaft 130 with play in the rotation direction by a predetermined angle range.

When the rotation shaft 130 rotates in the counterclockwise direction in FIG. 4, the engaging pin 130*a* abuts the abutting wall 33*b* so that the aligning roller holder 33 is swung in the retracting direction (the counterclockwise direction in FIG. 4). As illustrated in FIG. 8, when the light shielding piece 136*a* blocks the optical path of the angle detection sensor 140 so that the angle detection sensor 140 detects the light shielding piece 136*a*, rotation of the rotation shaft 130 is stopped, and the aligning roller holder 33 is disposed at the retract position (the position of the FIG. 7). Note that the rotation angle position when the light shielding piece 136*a* blocks the optical path of the angle detection sensor 140 is a home position of the rotation shaft 130.

The rotation shaft 130 is disposed at a predetermined rotation angle position in accordance with the number of the paper sheets P on the processing tray 30.

Figure 7:
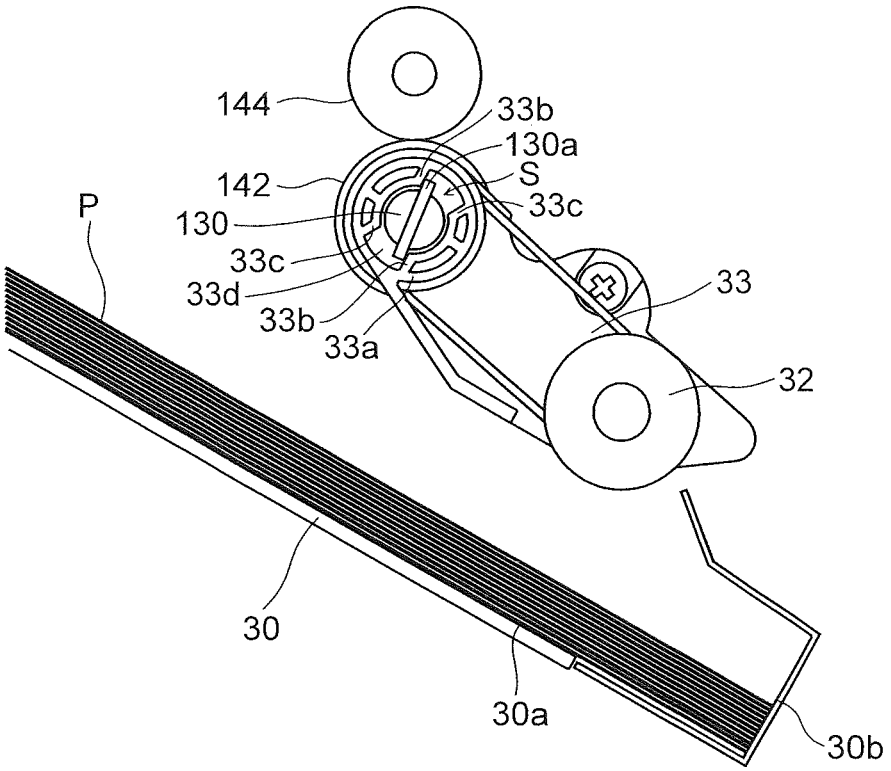
FIG. 7 is a cross-sectional view illustrating a structure of the aligning roller and its vicinity of the paper sheet post-processing device of one embodiment of the present disclosure, in a state where the roller holder is disposed at a retract position.
Figure 8:
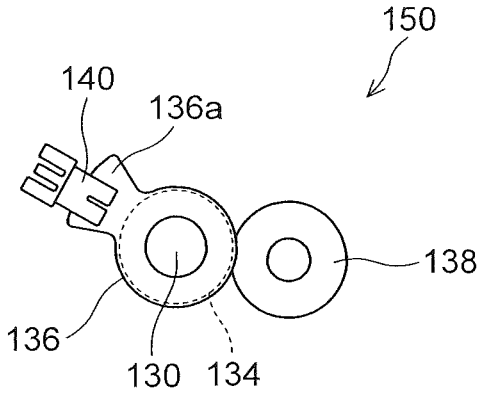
FIG. 8 is a diagram illustrating a structure of a light shielding member and its vicinity of the paper sheet post-processing device of one embodiment of the present disclosure, and shows a rotation angle position of the light shielding member in the state of FIG. 7.

For instance, if there is no paper sheet P on the processing tray 30, when the rotation shaft 130 is rotated from the home position in the clockwise direction in FIG. 7 by a predetermined rotation angle, the engaging pin 130*a* rotates in the clockwise direction, and the aligning roller holder 33 swings by gravity action in the contacting direction (the clockwise direction in FIG. 7) and is disposed at the contact position (the position of the FIG. 4). As illustrated in FIG. 3, a weight 143 is attached to the aligning roller holder 33 in this embodiment, and the aligning roller holder 33 is swung downward by gravity acting on the aligning roller 32, the aligning roller holder 33, and the weight 143. Note that the weight 143 is provided as necessary and may not be provided.

In addition, when the number of the paper sheets P on the processing tray 30 increases, the rotation shaft 130 is rotated in the counterclockwise direction in FIG. 4 by an angle corresponding to the number of the paper sheets P on the processing tray 30, and the aligning roller holder 33 is swung in the retracting direction (the counterclockwise direction in FIG. 4).

Figure 9:
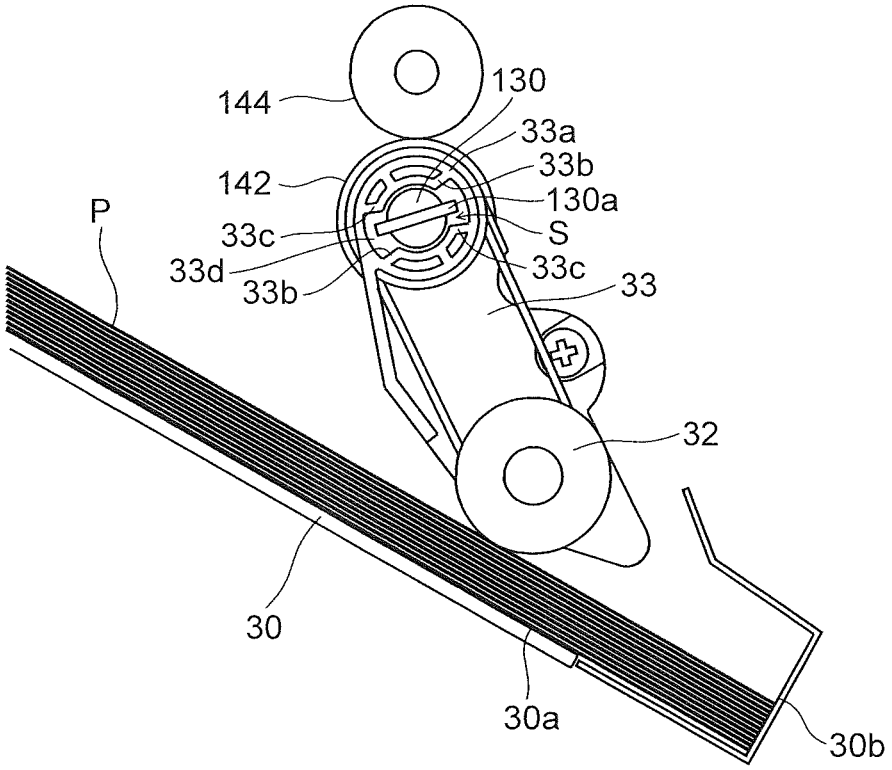
FIG. 9 is a cross-sectional view illustrating a structure of the aligning roller and its vicinity of the paper sheet post-processing device of one embodiment of the present disclosure, in a state where the aligning roller contacts with an upper surface of the topmost paper sheet on the processing tray.

Note that the engaging pin 130*a* is disposed with predetermined gaps to the abutting wall 33*b* and the abutting wall 33*c*, in the state where the aligning roller 32 contacts with the paper sheet stacking surface 30*a* of the processing tray 30 (the state of FIG. 4), and in the state where the aligning roller 32 contacts with the upper surface of the topmost paper sheet P on the processing tray 30 (the state of FIG. 9). The abutting wall 33*c* restricts swinging of the aligning roller holder 33 in the retracting direction, so that the aligning roller holder 33 is swingable in the retracting direction by an angle corresponding to the gap between the abutting wall 33*c* and the engaging pin 130*a*.

The post-processing control unit 81 (see FIG. 1) is constituted of a central processing unit (CPU), a read only memory (ROM), a random access memory (RAM), and the like, so as to control the whole of the paper sheet post-processing device 20. In addition, the post-processing control unit 81 receives information about thickness of the paper sheet stack (a type of the paper sheet P (material or thickness of the paper sheet P), the number of paper sheets P of one bundle, and the like), which is input by a user with an operation unit (not shown) of the image forming apparatus 100, via a receiving unit (obtaining portion) 82 (see FIG. 1) disposed in the post-processing device 20. In addition, the post-processing control unit 81 counts the number of the paper sheets P on the processing tray 30 based on a detection signal from the sheet detection sensor (not shown).

The post-processing control unit 81 changes the rotation angle position of the rotation shaft 130 based on at least the number of the paper sheets P on the processing tray 30. In this example, the post-processing control unit 81 sets the rotation angle position of the rotation shaft 130 between the contact position and the retract position, based on thickness of the paper sheet stack on the processing tray 30 (total thickness of the paper sheets P), i.e. the number of the paper sheets P on the processing tray 30 and information about thickness of one paper sheet P.

Here, when the rear ends of the paper sheets P on the processing tray 30 is aligned, the rear end of the paper sheet P after passing the intermediate roller pair 27 and knocked off by the knock member (not shown) may contact with the aligning roller 32 or the aligning roller holder 33 as illustrated in FIG. 4. In this case, the aligning roller holder 33 is swung (moved upward) in the retracting direction, and when the rear end of the paper sheet P passes below the aligning roller holder 33, the aligning roller holder 33 returns to a lower position. In this case, if the number of the paper sheets P on the processing tray 30 is small, an swinging amount of the aligning roller holder 33 swung by the paper sheet P (angle of swinging) is large, and hence the aligning roller 32 strongly abuts the upper surface of the paper sheet P when the aligning roller holder 33 returned to the lower position. In this way, a convey force applied to the paper sheet P is increased, and hence the rear end part of the paper sheet P (a part between the aligning roller 32 and the stop part 30*b*) is bent, resulting in a misalignment.

Accordingly, in this embodiment, if the number of the paper sheets P on the processing tray 30 is small when the aligning roller 32 contacts with the paper sheet stacking surface 30*a* or the upper surface of the paper sheet P (e.g. in the case of FIG. 4), the post-processing control unit 81 disposes the rotation shaft 130 at a predetermined rotation angle position so that the play of the roller holder 33 in the retracting direction becomes smaller than that in the case where the number of the paper sheets P is large (e.g. in the case of FIG. 9).

Specifically, as illustrated in FIG. 4, if the number of the paper sheets P on the processing tray 30 is small, the rotation shaft 130 is disposed so that a gap S between the engaging pin 130*a* and the abutting wall 33*c* (the play of the roller holder 33 in the retracting direction) is 1 mm or less, for example. In this way, even if the rear end of the paper sheet P abuts the aligning roller 32 or the aligning roller holder 33, the aligning roller holder 33 swings (is move upward) only a little in the counterclockwise direction. Therefore, it is possible to prevent the aligning roller 32 from strongly abutting the upper surface of the paper sheet P when the rear end of the paper sheet P passes below the aligning roller holder 33 and the aligning roller holder 33 returns downward.

On the other hand, if the number of the paper sheets P on the processing tray 30 is large (e.g. in the case of FIG. 9), the rotation shaft 130 is disposed so that the gap S between the engaging pin 130*a* and the abutting wall 33*c* is approximately 2 mm, for example. If the number of the paper sheets P on the processing tray 30 is large (e.g. in the case of FIG. 9), the aligning roller holder 33 is nearly parallel to the paper sheet stacking surface 30*a* of the processing tray 30, compared with the case where the number of the paper sheets P on the processing tray 30 is small (e.g. in the case of FIG. 4), and hence the swinging amount of the aligning roller holder 33 swung by the paper sheet P (angle of swinging) is small. Therefore, when the rear end of the paper sheet P passes below the aligning roller holder 33 and the aligning roller holder 33 returns downward, the aligning roller 32 does not strongly abut the upper surface of the paper sheet P, resulting in little misalignment.

Note that the gap S is a distance between a predetermined position of the engaging pin 130*a* and the abutting wall 33*c*. A value of the gap S may be defined by an angle between the engaging pin 130*a* and the abutting wall 33*c*, instead of the distance between the predetermined position of the engaging pin 130*a* and the abutting wall 33*c*.

Note that the post-processing control unit 81 gradually rotates the rotation shaft 130, so that the gap S between the engaging pin 130*a* and the abutting wall 33*c* (the play of the roller holder 33 in the retracting direction) is gradually increased, as the number of the paper sheets P on the processing tray 30 increases (e.g. every time when the number of paper sheets P is increased by approximately 10 to 20).

As described above, in this embodiment, the post-processing control unit 81 disposes the rotation shaft 130 at a predetermined rotation angle position, so that the play of the roller holder 33 in the retracting direction is smaller in the case where the number of the paper sheets P on the processing tray 30 is small, than in the case where the number of the paper sheets P is large, when the aligning roller 32 contacts with the paper sheet stacking surface 30*a* or the upper surface of the paper sheet P. In this way, when the number of the paper sheets P on the processing tray 30 is small, it is possible to decrease the angle of swinging when the rear end of the next paper sheet P contacts with the aligning roller 32 or the aligning roller holder 33 so as to push the aligning roller holder 33 upward. Therefore, it is possible to prevent the aligning roller 32 from strongly abutting the upper surface of the paper sheet P when the rear end of the next paper sheet P passes below the aligning roller holder 33 and the aligning roller holder 33 returns toward the contact position. In this way, it is possible to prevent the rear end part of the paper sheet P (a part between the aligning roller 32 and the stop part 30*b*) from bending due to an increase of the convey force applied to the paper sheet P, and hence it is possible to prevent occurrence of misalignment.

In addition, when the number of the paper sheets P on the processing tray 30 is large, the paper sheet stack is stiff, and hence the aligning roller 32 may excessively press the paper sheets P due to bending or the like of the paper sheet stack. In this embodiment, the play of the roller holder 33 in the retracting direction becomes larger in the case where the number of the paper sheets P on the processing tray 30 is large, than in the case where the number of the paper sheets P is small, and hence it is possible to prevent the aligning roller 32 from excessively pressing the paper sheets P.

In addition, as described above, the post-processing control unit 81 rotates the rotation shaft 130 so that the play of the roller holder 33 in the retracting direction gradually increases, as the number of the paper sheets P on the processing tray 30 increases. In this way, it is possible to set the play of the roller holder 33 in the retracting direction at an appropriate value in accordance with the number of the paper sheets P on the processing tray 30.

In addition, as described above, the shaft insertion portion 33*a* of the aligning roller holder 33 is provided with the abutting wall 33*c*, which is disposed to have the gap S to the engaging pin 130*a* when the aligning roller 32 abuts the upper surface of the topmost paper sheet P on the processing tray 30, and restricts swinging of the aligning roller holder 33 in the retracting direction. In this way, it is possible to easily restrict the swinging amount (angle of swinging) of the roller holder 33 caused by the rear end of the next paper sheet P.

In addition, as described above, the swinging mechanism 150 includes the light shielding member 136 that rotates together with the rotation shaft 130, and the angle detection sensor 140 that detects whether the optical path is open or blocked by the light shielding member 136, and the post-processing control unit 81 rotates the rotation shaft 130 in accordance with the detection result of the angle detection sensor 140. In this way, it is possible to easily dispose the rotation shaft 130 at a predetermined rotation angle position.

In addition, as described above, the post-processing control unit 81 disposes the rotation shaft 130 at a predetermined rotation angle position based on the information obtained by the receiving unit 82. In this way, the play of the roller holder 33 in the retracting direction can be easily set to an appropriate value.

Note that the embodiment disclosed in this specification is an example in every aspect and should not be interpreted as a limitation. The scope of the present disclosure is defined not by the above description of the embodiment but by the claims and should be understood to include all modifications within meaning and scope equivalent to the claims.

Figure 10:
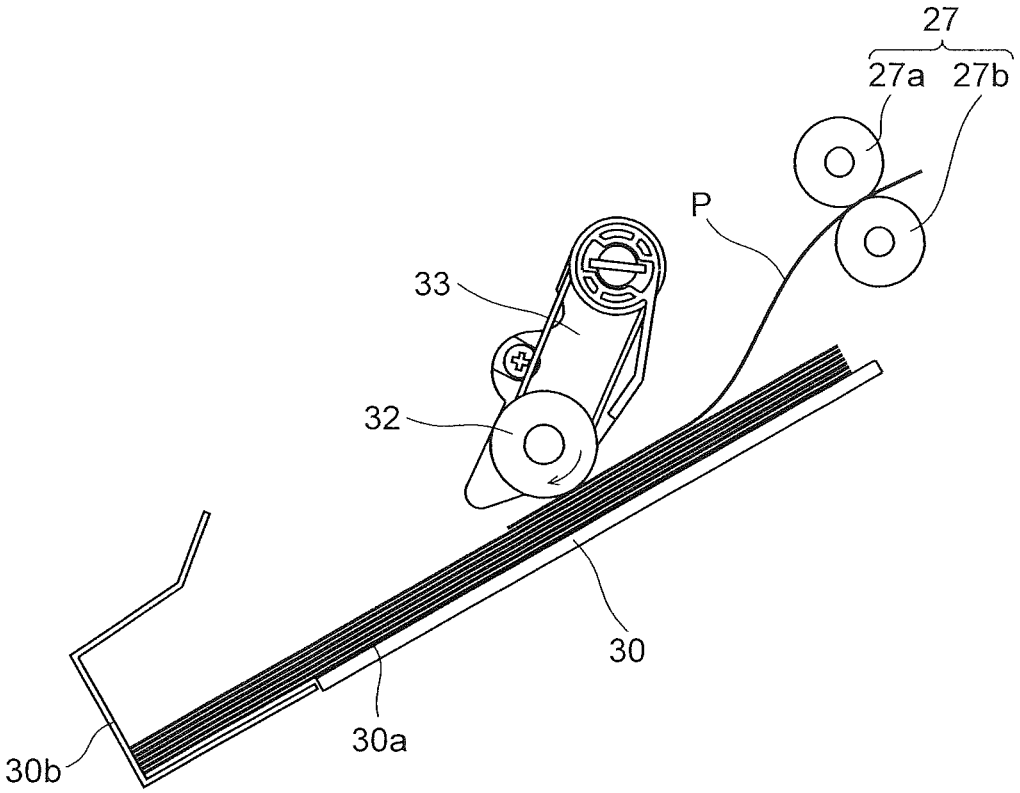
FIG. 10 is a cross-sectional view illustrating a structure of the aligning roller and its vicinity of the paper sheet post-processing device of a variation of the present disclosure.

For instance, the embodiment described above shows the example in which the aligning roller 32 draws in the paper sheet P in the direction opposite to the conveying direction by the intermediate roller pair 27 (in the right direction in FIG. 2), i.e. the rear ends of the paper sheets P are aligned, but the present disclosure is not limited to this. For instance, like the paper sheet post-processing device 20 of a variation of the present disclosure as illustrated in FIG. 10, it may be possible that the aligning roller 32 draws in the paper sheet P in the same direction as the conveying direction by the intermediate roller pair 27 (in the left direction in FIG. 10). In other words, it may be possible that the aligning roller 32 aligns the front ends of the paper sheets P.

In addition, the embodiment described above shows the example in which the roller (aligning roller) is used as the aligning member, but the present disclosure is not limited to this. It may be possible to use a paddle, a belt, or the like as the aligning member.

What is claimed is:

1. A sheet post-processing device comprising:

a conveying member for conveying sheets;

a processing tray disposed on a downstream side of the conveying member in a sheet conveying direction, the processing tray having a sheet stacking surface for receiving and stacking the sheets;

a discharge tray disposed on a downstream side of the processing tray in a sheet discharge direction;

a processing unit configured to perform a post-processing on the sheets on the processing tray;

an aligning member configured to contact with an upper surface of a topmost sheet of the sheets on the processing tray for aligning the sheets on the processing tray in the sheet discharge direction;

a holder which is swingable and for supporting the aligning member;

a swinging mechanism for causing the holder to swing; and a control unit configured to control the swinging mechanism, wherein the holder is swingable between a contact position at which the aligning member contacts with the upper surface of the topmost sheet of the sheets and a retract position at which the aligning member retracts from the upper surface of the topmost sheet of the sheets, the swinging mechanism includes a rotation shaft inserted into a shaft insertion portion of the holder with play in a rotation direction so as to be a swinging center of the holder, and a drive part for driving the rotation shaft to rotate, the control unit controls the rotation shaft to rotate and stop at a predetermined rotation angle position corresponding to a stack height of the sheets stacked on the processing tray, so that the holder is disposed at the contact position, at the contact position, the holder is allowed to swing in the retracting direction with respect to the rotation shaft within a predetermined play range, and the play range is set to be larger in proportion to the stack height of the sheets.

2. The sheet post-processing device according to claim 1, wherein the control unit rotates the rotation shaft so that the play of the holder in the retracting direction gradually increases, as the number of the sheets on the processing tray increases.

3. The sheet post-processing device according to claim 1, wherein the rotation shaft includes an engaging pin penetrating and protruding through the rotation shaft in a radial direction, and the holder includes an engaging groove formed at the shaft insertion portion so as to engage with the engaging pin with a predetermined play in the rotation direction.

4. The sheet post-processing device according to claim 1, wherein the swinging mechanism further includes a light shielding member disposed at one end part of the rotation shaft so as to rotate together with the rotation shaft, and a detection unit for detecting whether an optical path is open or blocked by the light shielding member, the drive part includes a stepping motor, and the control unit sets a home position of the rotation shaft as a rotation angle position at which the light shielding member shields the optical path, and rotates the rotation shaft from the home position so as to causes the holder to swing and dispose at the contact position.

5. The sheet post-processing device according to claim 1, wherein the processing tray is inclined downward toward an upstream side in the sheet discharge direction, the aligning member is disposed at a lower end part of the holder, and the holder is inclined to the upstream side in the sheet discharge direction from the shaft insertion portion toward the lower end part.

6. The sheet post-processing device according to claim 1, wherein the aligning member is an aligning roller configured to be rotatable by a rotation drive force, and contacts with the upper surface of the topmost sheet of the sheets to move the sheet in an upstream side in the sheet discharge direction, so that rear ends of the sheets comes into contact with a stop part provided to the processing tray and are aligned.

7. The sheet post-processing device according to claim 1, further comprising an obtaining portion configured to obtain information about the stack height, wherein the control unit disposes the rotation shaft at the predetermined rotation angle position based on the information obtained by the obtaining portion.

8. An image forming system comprising an image forming apparatus connected to the sheet post-processing device according to claim 1, wherein the image forming apparatus forms images on the sheets, and conveys the sheets to the sheet post-processing device.

9. A sheet post-processing device comprising:

a conveying member for conveying sheets;

a processing tray disposed on a downstream side of the conveying member in a sheet conveying direction, the processing tray having a sheet stacking surface for receiving and stacking the sheets;

a processing unit configured to perform a predetermined process on the sheets on the processing tray;

an aligning member configured to contact with an upper surface of a topmost sheet of the sheets stacked on the processing tray for aligning the sheets on the processing tray in the sheet discharge direction;

a holder for supporting the aligning member;

a swinging mechanism for swinging the holder; and a control unit configured to control the swinging mechanism, wherein the holder is swingable between a contact position at which the aligning member contacts with the upper surface of the topmost sheet of the sheets and a retract position at which the aligning member retracts from the upper surface of the topmost sheet of the sheets, the swinging mechanism includes a rotation shaft inserted into a shaft insertion portion of the holder with play in a rotation direction so as to be a swinging center of the holder, and a drive part for driving the rotation shaft to rotate, the control unit controls the rotation shaft to rotate and stop at a predetermined rotation angle position corresponding to a stack height of the sheets stacked on the processing tray, so that the holder is disposed at the contact position, and at the contact position, the holder is allowed to swing in the retracting direction with respect to the rotation shaft within a predetermined play range.

* * * * *